US009217220B2

(12) United States Patent
Ahn et al.

(10) Patent No.: US 9,217,220 B2
(45) Date of Patent: Dec. 22, 2015

(54) DRYER AND FOREIGN MATERIAL REMOVING APPARATUS THEREOF

(75) Inventors: Seung Phyo Ahn, Changwon (KR); Jeong Yun Kim, Changwon (KR); Sang Ik Lee, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 1188 days.

(21) Appl. No.: 12/640,187

(22) Filed: Dec. 17, 2009

(65) Prior Publication Data

US 2010/0146804 A1 Jun. 17, 2010

(30) Foreign Application Priority Data

Dec. 17, 2008 (KR) ..... 10-2008-0128603

(51) Int. Cl.

| | |
|---|---|
| ***F26B 21/06*** | (2006.01) |
| ***F26B 19/00*** | (2006.01) |
| ***F26B 3/00*** | (2006.01) |
| ***D06F 58/22*** | (2006.01) |

(52) U.S. Cl.

CPC ..... *D06F 58/22* (2013.01)

(58) Field of Classification Search

USPC ..... 34/82, 85, 292, 480, 587, 591, 667, 58; 285/7

See application file for complete search history.

(56) References Cited

U.S. PATENT DOCUMENTS

| | | | | |
|---|---|---|---|---|
| 2,951,714 | A * | 9/1960 | Carlberg | 285/7 |
| 3,710,451 | A * | 1/1973 | Buck | 34/79 |
| 3,802,570 | A * | 4/1974 | Dehne | 210/304 |
| 3,889,392 | A * | 6/1975 | Davis et al. | 34/82 |
| 3,959,891 | A * | 6/1976 | Burkall | 34/82 |
| 4,700,492 | A * | 10/1987 | Werner et al. | 34/403 |
| 5,042,170 | A * | 8/1991 | Hauch et al. | 34/82 |
| 5,067,253 | A * | 11/1991 | Hauch et al. | 34/82 |
| 5,560,120 | A * | 10/1996 | Swanson et al. | 34/82 |
| 5,706,588 | A * | 1/1998 | Dausch et al. | 34/327 |
| 6,016,610 | A * | 1/2000 | Sears | 34/82 |
| 6,402,962 | B1 * | 6/2002 | Bruntz et al. | 210/739 |
| 6,966,126 | B2 * | 11/2005 | Baurmann | 34/606 |
| 7,627,960 | B2 * | 12/2009 | Beyerle et al. | 34/602 |
| 7,640,678 | B2 * | 1/2010 | Lee et al. | 34/601 |
| 8,166,670 | B2 * | 5/2012 | Poy | 34/595 |
| 2005/0252022 | A1 * | 11/2005 | Tyau | 34/82 |
| 2006/0096335 | A1 * | 5/2006 | Park et al. | 68/20 |

(Continued)

FOREIGN PATENT DOCUMENTS

| | | |
|---|---|---|
| CN | 1888267 A | 1/2007 |
| EP | 1 380 683 A2 | 1/2004 |

(Continued)

OTHER PUBLICATIONS

Korean Notice of Allowance dated Sep. 20, 2011 issued in Application No. 10-2008-0128603.

(Continued)

*Primary Examiner* — Kenneth Rinehart
*Assistant Examiner* — John McCormack
(74) *Attorney, Agent, or Firm* — Ked & Associates, LLP

(57) ABSTRACT

The embodiment relates to a dryer and a foreign material removing apparatus thereof. With the dryer and the foreign material removing apparatus thereof, the convenience of user can be maximized by separating and cleaning only a case when the foreign materials are stored in the case above a predetermined amount without the user needing to clean the filter each time the dryer is used.

10 Claims, 6 Drawing Sheets

(56) References Cited

U.S. PATENT DOCUMENTS

| | | | | |
|---|---|---|---|---|
| 2008/0235978 | A1* | 10/2008 | Epstein | 34/82 |
| 2011/0167662 | A1* | 7/2011 | Dittmer et al. | 34/82 |

FOREIGN PATENT DOCUMENTS

| | | | |
|---|---|---|---|
| FR | 2924726 | A1 | 6/2009 |
| GB | 791351 | A | 2/1958 |
| KR | 10-0577249 | B1 | 5/2006 |
| KR | 10-0685965 | B1 | 2/2007 |

OTHER PUBLICATIONS

Korean Office Action dated Jan. 31, 2011 issued in Application No. 10-2008-0128603.

Chinese Office Action dated May 5, 2011 issued in Application No. 200910253769.3.

European Search Report issued in Application No. 09015557.3 dated Apr. 1, 2015.

* cited by examiner

DRYER AND FOREIGN MATERIAL REMOVING APPARATUS THEREOF

BACKGROUND OF THE INVENTION

1. Field of the Invention

The embodiment relates to a dryer and a foreign material removing apparatus thereof.

2. Description of the Related Art

In general, a dryer is an apparatus that dries a dry target by blowing hot wind generated by a heater into a rotary drum to absorb moisture of a drying target (i.e., clothes which has been washed).

The dryer is largely classified into an exhaust type dryer and a condensation type dryer in accordance with a processing scheme of wet air containing moisture generated by drying the drying target. More specifically, the exhaust-type dryer uses a scheme that discharges the wet air discharged from the drum to the outside of the dryer, while the condensation-type dryer use a re-circulation scheme that removes the moisture by condensing the wet air discharged from the drum in a heat-exchanger and thereafter, heats a dry air without moisture again and sends it to the drum.

Meanwhile, since the drum is formed in a rotation type, the drying target housed in the drum shakes in the drum as the drum rotates. In this process, foreign materials contained in the drying target are spread in the air. That is, the foreign materials are included in the air passing through the drum.

The foreign materials contained in the air causes troubles while passing through mechanical components of the dryer. In addition, the foreign materials contained in the air are discharged to the outside of the dryer to injure user's health. Therefore, while the air passing through the drum passes through a filter, the foreign materials should be removed from the air.

In general, the filter is provided at the front portion of the drum and filters the foreign materials contained in the air passing through the drum. When the foreign materials are accumulated in the filter at predetermined levels, circulation of the air is interfered, such that cleaning is required. In general, the filter is removably coupled to the dryer and after a drying cycle is terminated, the user separates and cleans the filter.

In particular, since the foreign materials which are contained in the wet air contain moisture, the foreign materials are damply attached to the filter. In addition, as the drying cycle is performed, when the amount of the moisture contained in the air decreases, the damply wet foreign materials adhere to the filter while being dried.

According to the dryer in the related art, in order to clean the filter to which the foreign materials is adhered, there is a problem in that the cleaning should be by the user effort, such as strongly shaking off the filter.

If the state where the foreign materials adhere to the filter is ignored, proper wind quantity is not secured. As a result, since the air heated by the heater is not cooled, there is a risk of fire.

In addition, since the filter cleaning operation should be performed whenever using the dryer in order to secure the wind quantity in the dryer and prevent firing, it is troublesome to the user.

SUMMARY OF THE INVENTION

The embodiment proposes to solve the above-mentioned problems. An object of the present invention is to provide a dryer including a filter to more facilitate cleaning and a foreign material removing apparatus thereof.

In addition, another object of the present invention is to provide a dryer that cleans a filter under a predetermined condition and a foreign material removing apparatus thereof.

Further, yet another object of the present invention is to provide a dryer that maintains wind quantity at a predetermined level to improve drying performance without a risk of fire and a foreign material removing apparatus.

In order to achieve the above objects, a dryer according to an embodiment of the present invention includes: a cabinet that forms an exterior; a drum that is provided inside the cabinet and houses a drying target; a base that includes a motor rotating the drum and a suction fan that moves air in the inside of the drum; a cyclone part that is disposed between the drum and the suction fan and guides the cyclone flow of the air discharged from the drum; and a removable foreign material case that stores the foreign materials separated from the air by the cyclone flow.

A foreign material removing apparatus of a dryer according to another embodiment includes: a guide part that guides air discharged from a drum; a cyclone part that is provided on one side of the guide part and generates cyclone flow; an air introduction part that introduces air in a tangential direction from the guide part; a filter member that has a plurality of through holes that are provided inside the cyclone part and separates the foreign materials in the air; and a foreign material discharge part that extends to the outside of the cyclone part and discharges the foreign materials separated from the air; and a foreign material case that is provided on one side of the cyclone part and stores the foreign materials discharged from the air discharge part.

A dryer according to yet another embodiment of the present invention includes: a drum that houses a drying target and is rotatably provided; a drum cover that rotatably supports the drum; an air duct that extends to one side of the drum cover and moves the air discharged from the drum; and a foreign material removing apparatus that is coupled to the air duct and separates the foreign materials from the air, wherein the foreign material removing apparatus includes: a cyclone part that generates the cyclone flow and includes a filter member that separates the foreign materials; a guide part that is coupled to one side of the air duct and guides the air flow to the cyclone part; and a foreign material case in which the foreign materials separated from the cyclone part drop and are stored and is separately coupled to the cyclone part.

With the dryer and the foreign material removing apparatus according to the present invention, it can clearly remove the foreign materials adhered to the filter only by the simple operation without using the user effort.

In addition, the convenience of user can be maximized by separating and cleaning only the case when the foreign materials are stored in the case above a predetermined amount without the user needing to clean the filter each time the dryer is used.

Further, since the wind quantity passing through the inside of the drum is secured at a predetermined level or more while the filter is automatically cleaned, there is no risk of firing.

Moreover, since the cleaning of the filter is not frequently performed and the foreign materials are automatically separated and stored in the foreign material case, the product image can be luxurious and the user satisfaction can be increased.

DETAILED DESCRIPTION OF THE PREFERRED EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, a detailed embodiment for implementing the idea of the present invention will be described with reference to the accompanying drawings.

Figure 1:
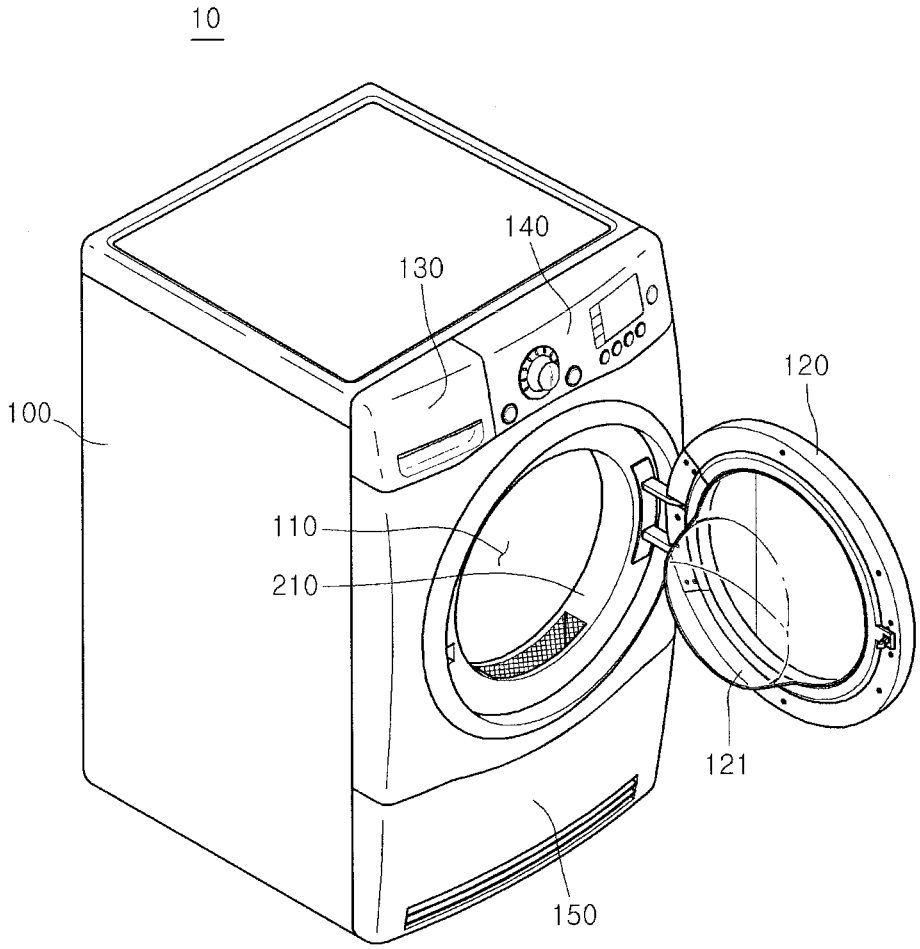
FIG. 1 is a perspective view showing an exterior of a dryer according to the embodiment of the present invention.

FIG. 1 is a perspective view showing an exterior of a dryer according to the embodiment of the present invention.

Hereinafter, a condensation-type dryer will be described as an embodiment in order to describe the spirit of the present invention. However, it is to be noted that the spirit of the embodiments is not limited to the condensation-type dryer and is applicable even to an exhaust-type dryer.

Referring to FIG. 1, a dryer 10 according to the first embodiment of the present invention includes a cabinet 100 forming an exterior thereof and having an opening part 110 formed on a front surface thereof and a door 120 that is rotatably connected to one side of the cabinet 100 and selectively opens and closes the opening part 110.

The inside of the cabinet 100 is provided with a drum 200 (see FIG. 2) that receives a drying target. A large quantity of moisture containing clothes, etc. can be input in the drum 200 through the opening part 110.

The door 120 is provided with a transparent window 121. Although the door 120 is closed, the user can view the inside of the drum 200 (FIG. 2) through the transparent window 121 to confirm the dried state.

A control unit 140 that can control a cycle of the dryer 10 is provided on one side of the cabinet 100. A display unit that displays a screen and a plurality of buttons that input predetermined commands are provided in the control unit 140.

A drawer 130 is provided on the front upper portion of the cabinet 100 to discharge condensed water that is generated using the drying process of the drying target. When the condensed water is stored in the drawer 130 above a predetermined quantity, the user can draw out the drawer 130 to drain the condensed water.

A lower cover 150 is removably provided on the front lower portion of the cabinet 100. The lower cover 150 plays a role of covering a heat exchanger 260 (see FIG. 2) cooling air that circulates in the dryer 10 so that the heat exchanger 260 is not viewed from the outside. The user separates the lower cover 150 from the cabinet 100 and thereafter, draws out the heat exchanger 260 for cleaning.

Meanwhile, a foreign material removing apparatus 400 removing the foreign materials contained in the air passing through the drum 200 is provided on one side of the drum 200. Hereinafter, the detailed configuration thereof will be described.

Figure 2:
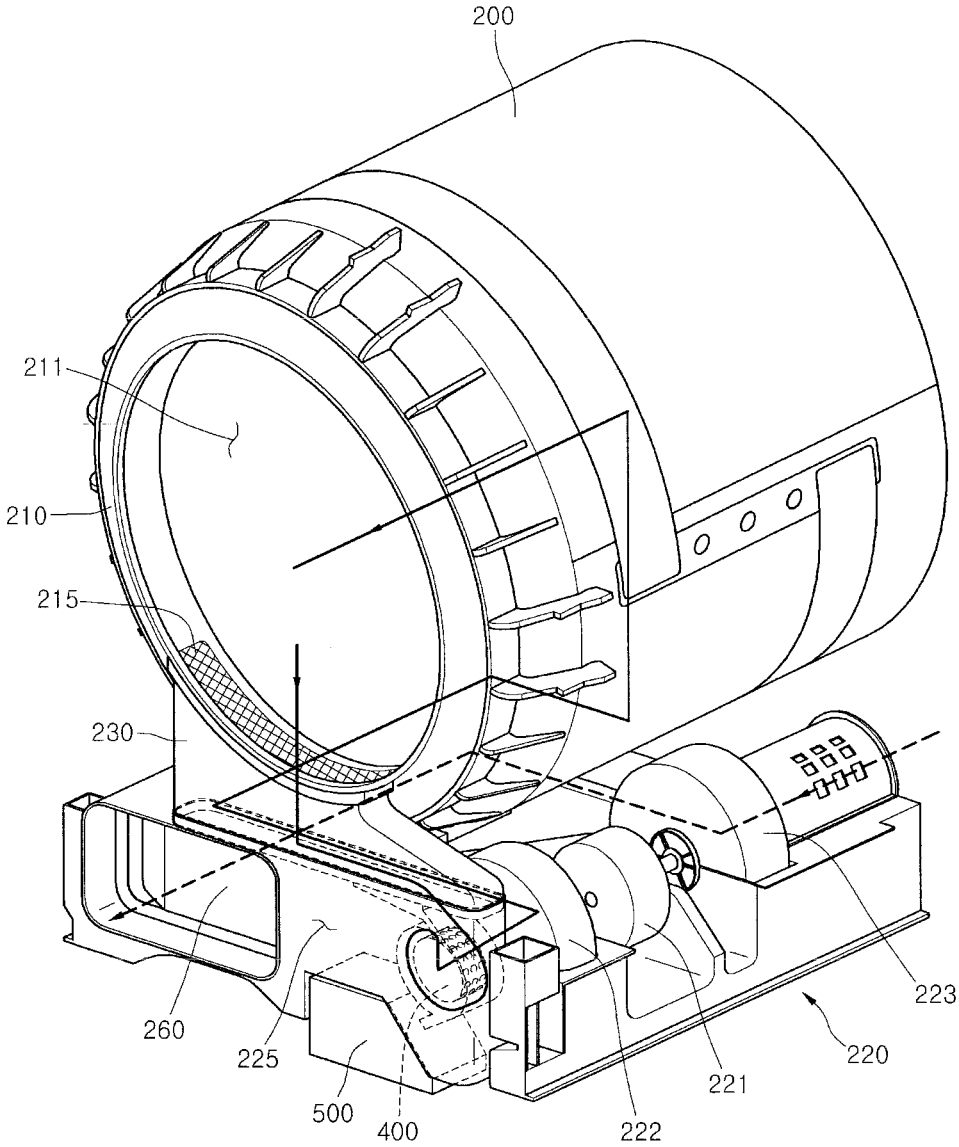
FIG. 2 is a diagram showing a configuration of main inner components of a dryer shown in FIG. 1.
Figure 3:
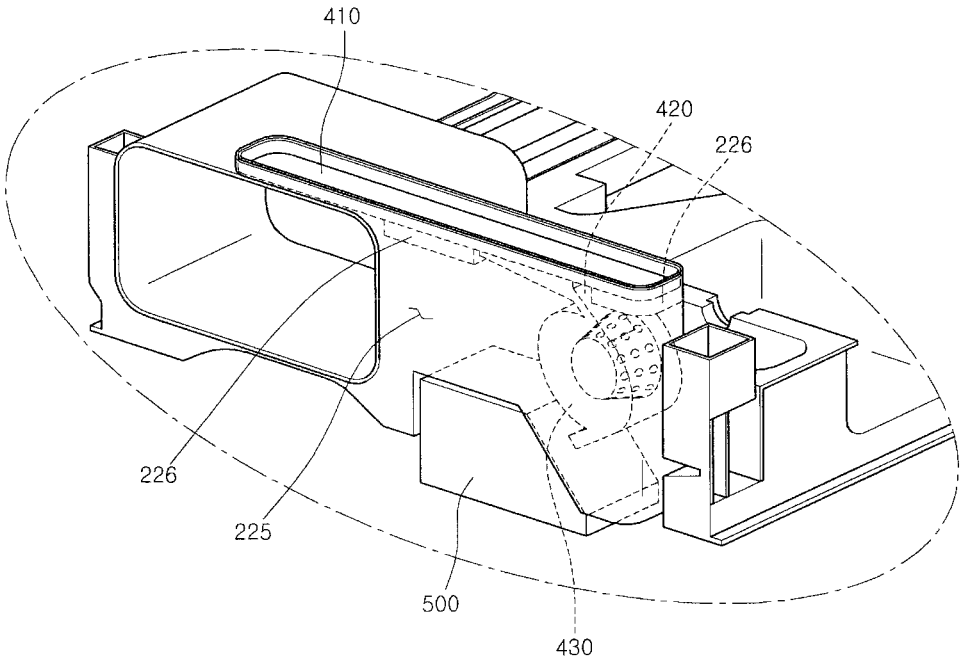
FIG. 3 is a diagram showing an appearance that a foreign material removing apparatus is mounted on a base of FIG. 2.

FIG. 2 is a diagram showing a configuration of main inner components of a dryer shown in FIG. 1 and FIG. 3 is a diagram showing an appearance that a foreign material removing apparatus is mounted on a base of FIG. 2.

Referring to FIGS. 2 and 3, the cabinet 100 includes the drum 200 housing the drying target, a drum cover 210 that is coupled to the front surface of the drum 200 to support the drum 200, a motor 221 that is provided in a lower portion of the drum 200 to rotate the drum 200, a base 220 including a suction fan 222 that is connected to the motor 221 to move the air in the drum 200, and a connection duct 230 that connects the front portion of the drum 200 to the base 220 and guides air discharged from the drum 200 to the base 220.

More specifically, the drum 200 has a cylindrical shape of which the front surface and the rear surface are opened and the front surface is disposed to face the opening part 110. The front surface of the drum 200 is rotatably connected to the drum cover 210. A belt, etc., is provided in the drum cover 210 that is in contact with the drum 200 to allow the drum 200 to smoothly rotate.

The drum cover 210 supports the drum 200 and is mounted to be coupled with the upper portion of the front end portion of the base 220. The drum cover 210 includes an input hole 211 that is formed at an input hole 211 corresponding to the opening part 110 and the front surface of the drum 200. The drying target can be input into the drum 200 through the input hole 211.

Further, the connection duct 230 is formed in the lower portion of the input hole 211 so as to circulate the air passing through the drum 200. The upper and lower end portions of the connection duct 230 are opened to allow the air to pass through the connection duct 230. The foreign material removing apparatus 400 is provided on the lower portion of the connection duct 230.

A grill 215 is provided at a boundary portion of the connection duct 230 and the input hole 211, such that the drying target is not introduced into the connection duct 230.

The base 220 forms the bottom surface of the dryer 10 and supports the drum 210. In detail, a rotation motor 221 that rotates the drum 200 is provided in the base 220. The rotation motor 221 is approximately provided at a central portion of the base 220 and is connected to the drum 200 by a belt (not shown) to rotate the drum 200.

In addition, the suction fan 222 that moves air in the drum 200 is provided in the base 220. The suction fan 222 is rotatably connected to the motor 221 and is provided at the front portion of the motor 221.

A cooling fan 223 that is rotated by the rotation motor 221 and sucks the external air is provided at the rear portion of the motor 221. The external air sucked by the cooling fan 223 exchanges heat with circulation air while passing through the heat exchanger 260.

In addition, a heater (not shown) that heats the circulation air is provided in a rear portion of the drum 200. The circulation air may be heated while passing through the heater and may then be introduced into the drum 200.

The heat exchanger 260 that allows the air which circulates in the drum 200 and the air introduced from the outside of the dryer 10 to exchange heat is provided in one side of the base 220.

The heat exchanger 260 is provided to be drawn in and out from the front of the base 220. The user can draw out the heat exchanger 260 for cleaning.

The foreign material removing apparatus 400 is provided in the base 220.

In detail, a foreign material removing apparatus housing part 225 in which the foreign material removing apparatus 400 is housed is provided in the front portion of the base 220. The upper surface of the foreign material removing apparatus housing part 225 is opened to correspond to the lower end portion of the connection duct 230, that is, the outlet shape of the connection duct 230.

The connection duct 230 is coupled with the upper portion of the foreign material removing apparatus housing part 225 and the air discharged from the drum 200 can be introduced into the foreign material removing apparatus 400 while passing through the connection duct 230.

The foreign material removing apparatus 400 includes a cyclone part 430 in which cyclone flow is generated, an air introduction part 420 that is provided on one side of the cyclone part 430 and into which air is introduced, a guide part 410 (also called guide unit) that is connected to the air introduction part 420 and corresponds to the upper shape of the foreign material removing apparatus housing part 225, a filter unit 440 that is provided in the cyclone part 430 and filters foreign materials, a foreign material discharge port 450 that discharges foreign materials separated during the process of the cyclone flow, and an air discharge hole 460 that discharges air from which the foreign materials are filtered.

In detail, the guide part 410 guides the air discharged from the drum 200 to the inside of the cyclone part 430 and has a shape corresponding to the connection duct 230 and the upper end portion of the foreign material removing apparatus housing part 225. The edge portion of the guide part 410 is disposed to be closed to the inner side surface of the foreign material removing apparatus housing part 225.

The air introduction part 420 extends to the cyclone part 430 from the guide part 410 to allow the air passing through the guide part 410 to introduce into the cyclone part 430. The air introduction part 420 can extend in a tangential direction of the cyclone part 430 so as to easily generate the cyclone flow.

The air introduced from the air introduction part 420 performs the cyclone flow along an inner peripheral surface of the cyclone part 430. At this time, the foreign materials can be separated from the air. The separated foreign materials are discharged through the foreign material discharge hole 450. The foreign material discharge hole 450 may extend in the tangential direction of the cyclone part 430.

A foreign material case 500 is provided on the lower portion of the cyclone part 430. The foreign materials discharged from the foreign material discharge hole 450 are stored in the foreign material case 500. A housing groove corresponding to the foreign material case 500 is formed on the base 200 and the foreign case 500 is mounted to be housed in the housing groove.

The foreign material case 500 can be removably coupled to the base 220 or the foreign material discharge hole 450 and can be provided to be drawn out to the front of the base 220. That is, the user separates the lower cover 150 and draws out the foreign material case 500, thereby making it possible to separate and discharge the foreign materials from the dryer 10.

Further, a foreign material case cover 520 (see FIG. 5) is removably provided at one side of the foreign material case 500 to discharge the foreign materials stored in the foreign material case 500.

The air discharge hole 460 is formed on one side of the cyclone part 430 and is positioned at the front (inlet side) of the suction fan 222. The suction force due to the rotation of the suction fan 222 is operated as the foreign material removing apparatus 400 and the cyclone flow in the cyclone part 430 is generated by the suction force.

The foreign material removing apparatus 400 is coupled upward from the lower portion of the foreign material removing apparatus housing part 225.

The foreign material removing apparatus housing part 225 is provided with a guide rib 226 that guides the coupling of the foreign material removing apparatus 400. The guide rib 226 is configured so that the guide part 410 can be supported to the upper portion of the foreign material removing apparatus housing part 225. The air discharge hole 460 can be positioned at the front of the suction fan 222 in the state where the guide part 410 is coupled with the upper portion of the foreign material removing apparatus housing part 225.

Hereinafter, the air flow in the dryer 10 having the above configuration will be described briefly.

The dryer 10 is a condensation-type dryer and is operated in a scheme that the air (a solid line arrow of FIG. 2, hereinafter, circulation air) circulating in the dryer 10 is cooled by the air (a dotted line arrow of FIG. 2, hereinafter, cooling air) introduced from the outside of the dryer 10.

In detail, the circulation air in the drum 200 includes a large quantity of moisture containing foreign materials. The circulation air moves forward by the rotation of the suction fan 222 and is discharged from the drum 200. The circulation air discharged from the drum 200 is introduced into the foreign material removing apparatus 400 through the connection duct 230.

The circulation air introduced into the foreign material removing apparatus 400 performs the cyclone flow and the foreign materials separated during this process are discharged to the outside of the foreign material removing apparatus 400.

Meanwhile, the circulation air passing through the foreign material removing apparatus 400 moves to the heat exchanger 260 through the suction fan 222 and is cooled while heat-exchanging with the cooling air in the heat exchanger 260. At this time, the moisture contained in the circulation air is condensed to be changed to the condensed water and the condensed water moves the drawer 130 and is stored therein.

The cooled circulation air moves to the rear part of the base 220 and is heated at high temperature by the heater. The circulation air heated at high-temperature is introduced into the drum 200 and circulates in the dryer 10.

Meanwhile, the cooling air is sucked into the base 220 from the rear part of the dryer 10 by the rotation of the cooling fan 223 and moves to the heat exchanger 260. The cooling air sucks heat by heat-exchanging with the circulation air in the heat exchanger 260 and is discharged to the front or side parts of the dryer 10.

Hereinafter, the configuration and operation of the foreign material removing apparatus 400 will be described with reference to the drawings.

Figure 4:
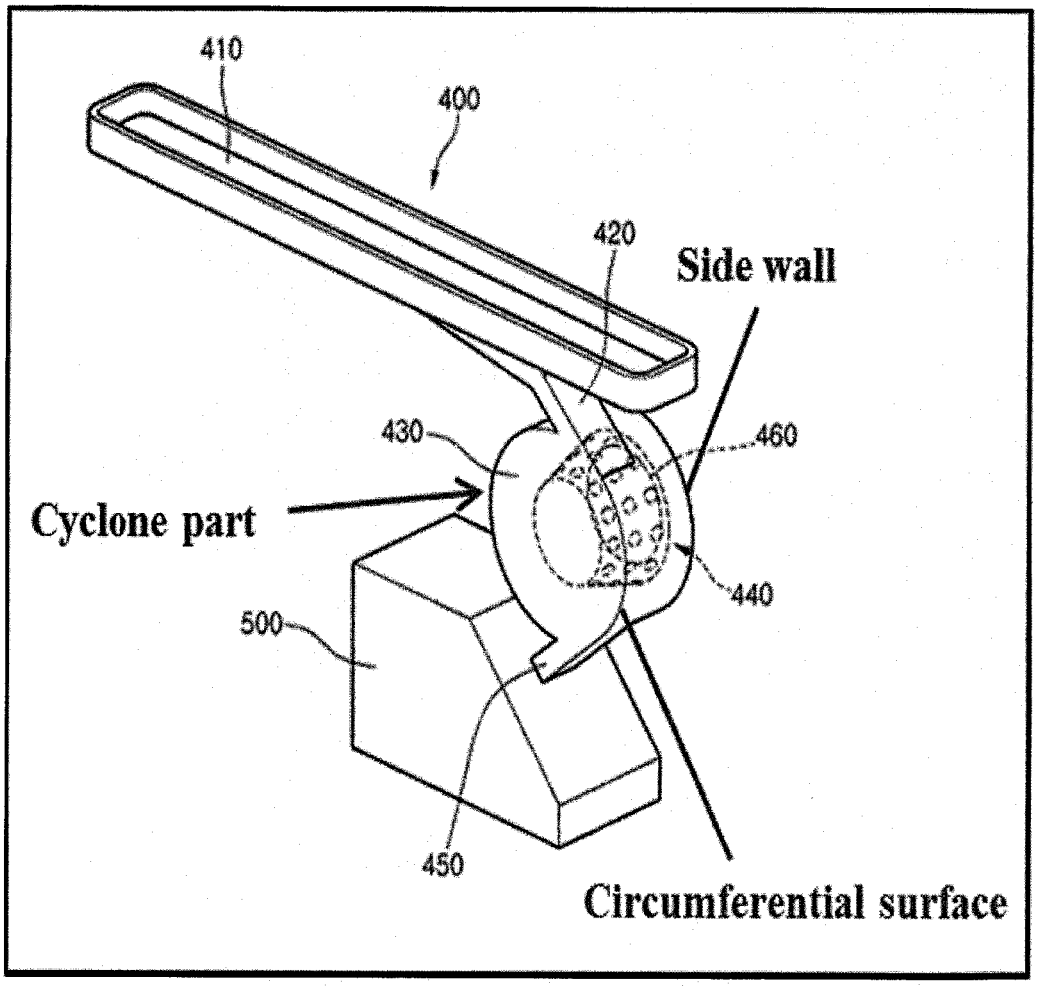
FIG. 4 is a perspective view showing the foreign material removing apparatus and a foreign material case of FIG. 2.
Figure 5:
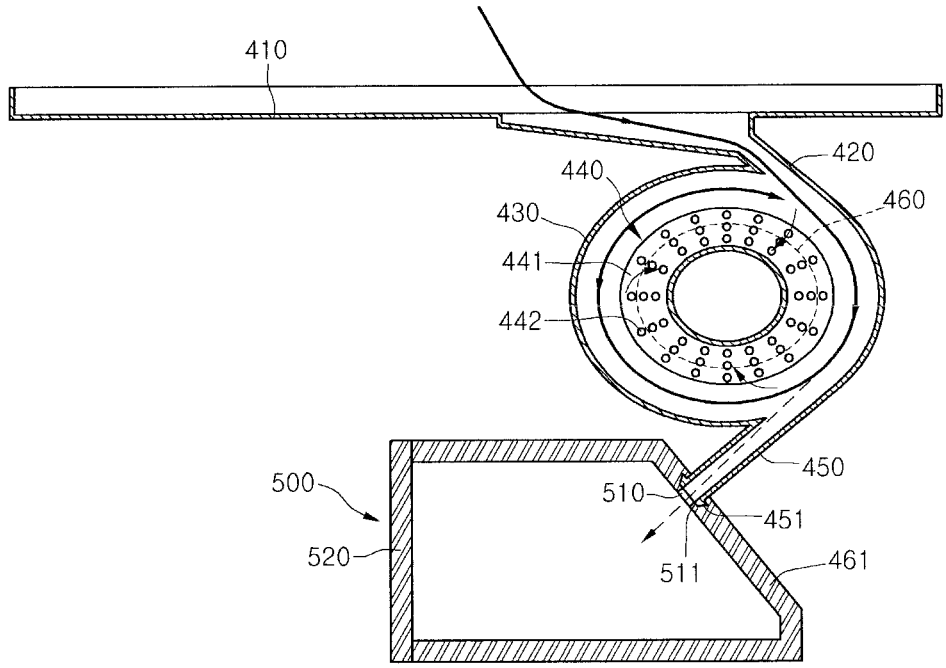
FIG. 5 is a cross-sectional view taken along line I-I' of FIG. 4.
Figure 6:
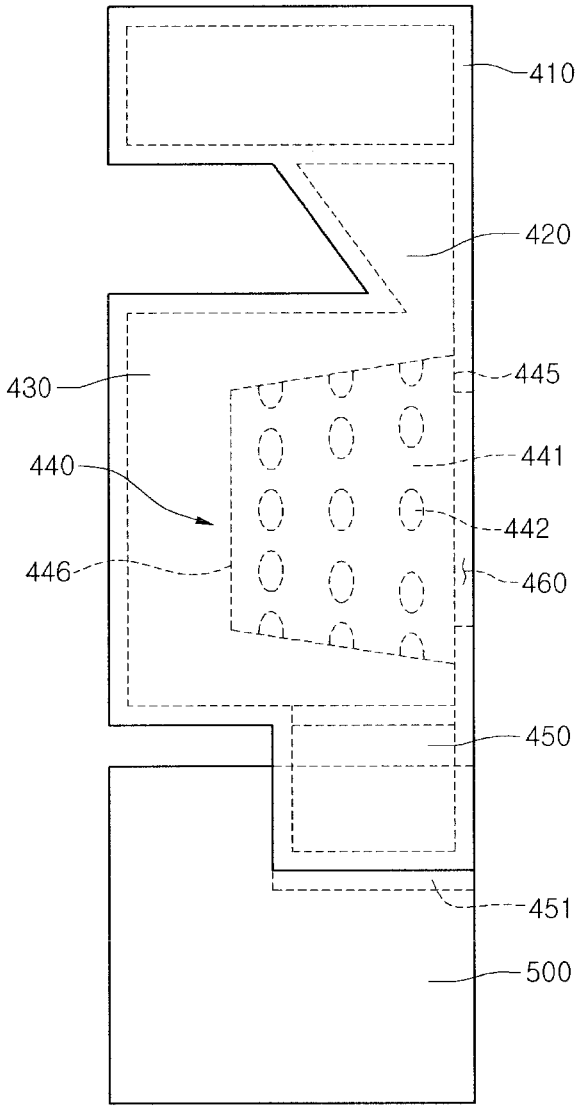
FIG. 6 is a right side view of FIG. 4.

FIG. 4 is a perspective view showing the foreign material removing apparatus and a foreign material case of FIG. 2, FIG. 5 is a cross-sectional view taken along line I-I' of FIG. 4, and FIG. 6 is a right side view of FIG. 4.

Referring to FIGS. 4 to 6, the cyclone part 430 according to the embodiment of the present invention has an approximately cylindrical shape and one surface of the cyclone part 430 is disposed toward the suction fan 222. One surface of the cyclone part 430 can be provided to be closed to the housing part of the suction fan 222, thereby making it possible to prevent the leakage of air.

The air discharge hole 460 is formed on one surface of the cyclone part 430. The suction force of the suction fan 222 is applied to the cyclone part 430 through the air discharge hole 460 and the air without the foreign materials in the cyclone part 430 can flow to the suction fan 222 through the air discharge hole 460.

The filter unit 440 extends from one side of the cyclone part 430 in which the air discharge hole 460 is formed to the inside of the cyclone part 430. The filter unit 440 includes a first end portion 445 that is coupled to the air discharge hole 460 and a second end portion 446 that extends from the first end portion 445 to the inside of the cyclone part 430 and forms one side end portion.

The direction that the filter unit 440 extends to the second end portion 446 from the first end portion 445 intersects with the flowing direction of air introduced through the air introduction part 420.

That is, the air introduced through the air introduction part 420 flows in the tangential direction of the cyclone part 430, while the filter unit 440 can be provided therein from one side of the cyclone part 430 to the central portion of the cyclone part 430.

The cross section of the cyclone part 440 can be provided in an oval shape. The cross section is defined in a cross section formed in the state where it is cut in a direction parallel with one surface of the cyclone part 430 in which the air discharge hole 460 is formed.

In other words, the width of the filter unit 440, that is, the cross sectional area thereof is formed to be narrow as going to the second end portion 446 from the first end portion 445. Since the speed of air introduced from the air introduction hole 420 is formed to be slower than the speed of the periphery of the second end portion 446 side and the periphery of the first end portion 445, the width of the filter unit 440 is formed to be narrower in the internal direction of the cyclone part 430, thereby making it possible to smoother perform the cyclone flow.

To this end, the filter unit 440 includes a tilted surface 441 that is formed to be tilted toward the inside of the cyclone part 430 from the air discharge hole 460. A plurality of through holes 442 are formed on the tilted surface 441. The foreign materials separated by the cyclone flow can be filtered in the through hole 442.

The guide part 410 of which the upper surface has an opened rectangular parallelepiped shape and has an edge portion corresponding to the inlet shape of the foreign material removing apparatus housing part 225. The air passing through the connection duct 230 is guided by the guide part 410 and can be introduced into the cyclone part 430.

The air introduction part 420 is provided on the lower part of the guide part 410 and is connected to one side of the cyclone part 430. The air introduction part 420 can be provided in a nozzle shape.

In other words, the air introduction part 420 is formed so that the cross sectional area is narrow as going to the cyclone part 430 side from the guide part 410 side, that is, the size of the passage is small.

In this case, since the flow rate of air is increased while the air is introduced from the air introduction hole 420 to the cyclone part 430, the cyclone flow can be better formed and the centrifugal force is large, thereby making it possible to increase the separation effect of the foreign materials.

The air introduction hole 420 is disposed so that the air can be introduced into a point where the cyclone part 440 is connected to the cyclone part 430, that is, to the first end portion 445. The air introduced from the air introduction hole 420 forms the cyclone flow while moving in the internal direction of the cyclone part 430.

The second end portion 446 of the cyclone part 440 is shielded so that air is not introduced thereinto. Therefore, the air introduced into the cyclone part 430 can flow to the air discharge hole 460 through the through hole 442.

The foreign material discharge port 450 is formed to extend in the tangential direction of the cyclone part 440 according to the rotation direction of air that rotates the periphery of the filter unit 440. The foreign material discharge port 450 extends to the outer lower part of the cyclone part 430 so that the foreign materials can easily drop to the foreign material case 500.

Air flows along the inner surface of the cyclone part 430 by the centrifugal force and the foreign materials contained in air will be discharged to the lower part along the foreign material discharge port 450 by gravity.

The lower end portion (outlet) of the foreign material discharge port 450 is provided with a hook 451 so that the foreign material case 500 is firmly coupled.

A foreign material introduction hole 510 into which the foreign materials discharged from the cyclone part 430 is formed on one side of the foreign material case 500.

The foreign material introduction hole 510 is formed with a hooking groove 511 to which the hook 451 is coupled. The foreign material discharge port 450 can be firmly coupled to the foreign material case 500 by coupling the hook 451 to the hooking groove 511, thereby making it possible to prevent the foreign materials from being discharged to the outside of the foreign material case 500.

When the foreign materials are stored in the foreign material case 500 above a predetermined level, the user separate the lower cover 150 and pulls out the foreign material case 500 forward. The user opens the foreign material case cover 520 and discharges the foreign materials stored in the foreign case 500, such that he and she can clean the foreign materials discharged in the drying process.

According to the dryer 10 and the foreign material removing apparatus 400 according to the embodiment of the present invention, the convenience of user can be maximized by separating only the foreign material case 500 and removing the foreign materials therein in the case where the foreign materials are stored above a predetermined amount without the user needing to clean the filter each time the dryer 10 is used.

Moreover, since the cleaning of the filter is not frequently performed and the foreign materials are automatically separated and stored in the foreign material case 500, the product image can be luxurious and the user satisfaction can be increased.

Moreover, since the foreign materials are automatically separated and discharged such that the wind quantity passing through the inside of the drum 200 is maintained at a predetermined level or more, the drying performance is performed and there is no risk of firing.

What is claimed is:

1. A dryer, comprising:

a cabinet that forms an exterior;

a drum that is provided inside the cabinet and that houses a drying target;

a base that includes a motor to rotate the drum and a suction fan that moves air inside of the drum;

a cyclone part that is disposed between the drum and the suction fan and that guides a cyclone flow of the air discharged from the drum, the cyclone part provided with a body having a circumferential surface and a side wall coupled to the circumferential surface of the body; and a foreign material case that stores foreign materials separated from the air by the cyclone flow, wherein the cyclone part comprises:

an air introduction part provided at the circumferential surface of the body and into which air is introduced;

an air discharge part formed at the side wall of the cyclone part to discharge air from which foreign materials are separated, a foreign material discharge port that is coupled to the body and is to discharge the foreign materials separated from the air to the foreign material case; and a filter member disposed within the cyclone part to filter the foreign materials, the filter member including an enclosure having a tilted surface, wherein the enclosure includes a first end portion that is coupled to the air discharge hole and that forms a first end of the tilted surface, a second end portion disposed at an opposed side of the first end portion and that forms a second end of the tilted surface, and a plurality of through holes formed at the tilted surface of the enclosure, wherein the air introduction part extends in a tangential direction of the body, and the foreign material discharge port extends in the tangential direction of the body, and wherein a direction of extension of the air introduction part is approximately vertical to a direction of extension of the foreign material discharge port.

2. The dryer according claim 1, further comprising:

a connection duct that moves air discharged from the drum; and a guide unit that is coupled to the connection duct and that guides air passing through the connection duct to the air introduction part.

3. The dryer according to claim 2, wherein the air introduction part extends in the tangential direction of the cyclone part from the guide unit and introduces air into the cyclone part.

4. The dryer according to claim 1, wherein a diameter of the first end portion is larger than a diameter of the second end portion.

5. The dryer according to claim 3, wherein a flow direction introduced from the air introduction part intersects with an extending direction of the filter member.

6. The dryer according to claim 1, wherein the foreign material case is disposed at a lower side of the cyclone part.

7. The dryer according to claim 1, wherein the foreign material case is removably coupled to the foreign material discharge port.

8. The dryer according to claim 1, wherein the air introduction part is formed so that a size of the passage is small as going to the cyclone part side from the guide part side.

9. The dryer according to claim 1, wherein the filter member extends from the side wall of the cyclone part to an inside of the cyclone part.

10. The dryer according to claim 1, wherein the foreign materials separated from the cyclone part drop and are stored in the foreign material case, and the foreign material case is separately coupled to the cyclone part, and the foreign material case includes a foreign material introduction hole into which the foreign materials are introduced, and wherein the foreign material discharge port is provided with a hook and the foreign material introduction hole is formed with a hooking groove that is selectively coupled to the hook of the foreign material discharge port.

* * * * *